US005335308A

United States Patent [19]

Sorensen

[11] Patent Number: 5,335,308

[45] Date of Patent: Aug. 2, 1994

[54] MOVABLE HEAT TREAT APPARATUS WITH SIGHTING MEANS

[75] Inventor: Thomas M. Sorensen, White Bear Lake, Minn.

[73] Assignee: BGK Finishing Systems, Inc., Blaine, Minn.

[21] Appl. No.: 122,356

[22] Filed: Sep. 17, 1993

Related U.S. Application Data

[63] Continuation of Ser. No. 878,047, May 4, 1992, abandoned.

[51] Int. Cl.[5] ..... F26B 3/30

[52] U.S. Cl. ..... 392/412; 392/415; 374/121; 356/43; 356/1; 250/491.1

[58] Field of Search ..... 392/411, 412, 415; 374/121, 124; 356/1, 375, 373, 43, 46, 48, 376; 250/491.1, 201.6, 222.1, 221, 561, 338.3; 33/DIG. 21

[56] References Cited

U.S. PATENT DOCUMENTS

| | | | |
|---|---|---|---|
| 2,813,203 | 11/1957 | Machler | 356/43 |
| 3,441,348 | 4/1969 | Nichols et al. | 356/43 |
| 3,693,143 | 9/1972 | Kennedy | 356/1 |
| 4,322,627 | 3/1982 | Pirlet | 250/561 |
| 4,346,293 | 8/1982 | Fetzer | 250/222.1 |
| 4,647,775 | 3/1987 | Stein | 250/338.1 |
| 4,753,528 | 6/1988 | Hines | 356/1 |
| 4,761,072 | 8/1988 | Pryor | 356/1 |
| 4,801,212 | 1/1989 | Imura | 356/43 |
| 4,978,841 | 12/1990 | Barrett | 356/1 |
| 5,050,232 | 9/1991 | Bergman | 392/412 |
| 5,102,231 | 4/1992 | Loewenstein et al. | 356/43 |

FOREIGN PATENT DOCUMENTS

| | | | |
|---|---|---|---|
| 59-94024 | 5/1984 | Japan | 356/43 |
| 59-128420 | 7/1984 | Japan | 356/43 |
| 2-291932 | 12/1990 | Japan | 356/46 |
| 3-37529 | 2/1991 | Japan | 356/43 |

OTHER PUBLICATIONS

OMEGA Engineering, *The Temperature Handbook* vol. 28, "Introduction to Infrared Pyrometers", pp. J-3, J-4, 1992.

*Primary Examiner*—Bruce A. Reynolds
*Assistant Examiner*—John A. Jeffery
*Attorney, Agent, or Firm*—Merchant, Gould, Smith, Edell, Welter & Schmidt

[57] ABSTRACT

An apparatus for heat treating the surface of a body includes an infrared heat source carried on a stand. A circuit controls the energization of the lamp. The circuit includes a heat detector for detecting a targeted area temperature. The apparatus includes a sighting mechanism to permit an operator to accurately sight the heat detector against the surface to be heat treated.

8 Claims, 7 Drawing Sheets

MOVABLE HEAT TREAT APPARATUS WITH SIGHTING MEANS

This is a continuation of application Ser. No. 07/878,047, filed May 4, 1992, now abandoned.

BACKGROUND OF THE INVENTION

1. Field of The Invention

This invention pertains to an infrared heater for heat treating a surface. More specifically, this invention pertains to such an apparatus with means for sighting the apparatus.

2. Background Art

U.S. Pat. No. 5,050,232 dated Sep. 17, 1991, teaches an apparatus for heat treating the surface of a body. For example, the apparatus is used to touch-up repair of paint on an automobile surface. The apparatus of U.S. Pat. No. 5,050,232 includes a movable stand with infrared heaters. The stand is rolled across a work surface toward and away from an automobile body. As a result, the infrared heaters may be positioned adjacent to an area of the body surface to be heat treated. U.S. Pat. No. 5,050,232 teaches the use of closed-loop proportional control to control the intensity of the heating lamps while using the apparatus.

As disclosed in U.S. Pat. No. 5,050,232, an optical pyrometer (item 62 in the drawings of the '232 patent) is centrally positioned within the bank of infrared lamps and aimed at the automobile surface to be heat treated. Correct pyrometer aiming is important due to the fact that the closed-loop control can only control to the level of accuracy of the feed back information given to it. For example, the apparatus will not control well if the pyrometer is aimed through a vehicle window or at a wheel well.

It is an object of the present invention to provide means for improved aiming or sighting of an apparatus of the type such as that shown in U.S. Pat. No. 5,050,232.

SUMMARY OF THE INVENTION

According to a preferred embodiment of the present invention, an apparatus is provided for heat treating the surface of a body. The apparatus includes a panel of infrared lamps and a stand for mounting the lamps in at least one of a plurality of positions. A heat detector is provided for detecting a temperature of a surface to be heat treated. A sighting mechanism is provided for aiming the lamps at the surface with the sighting mechanism including means for indicating to an operator a location on the surface against which the heat detection means is aimed.

DESCRIPTION OF THE PREFERRED EMBODIMENT

Figure 1:
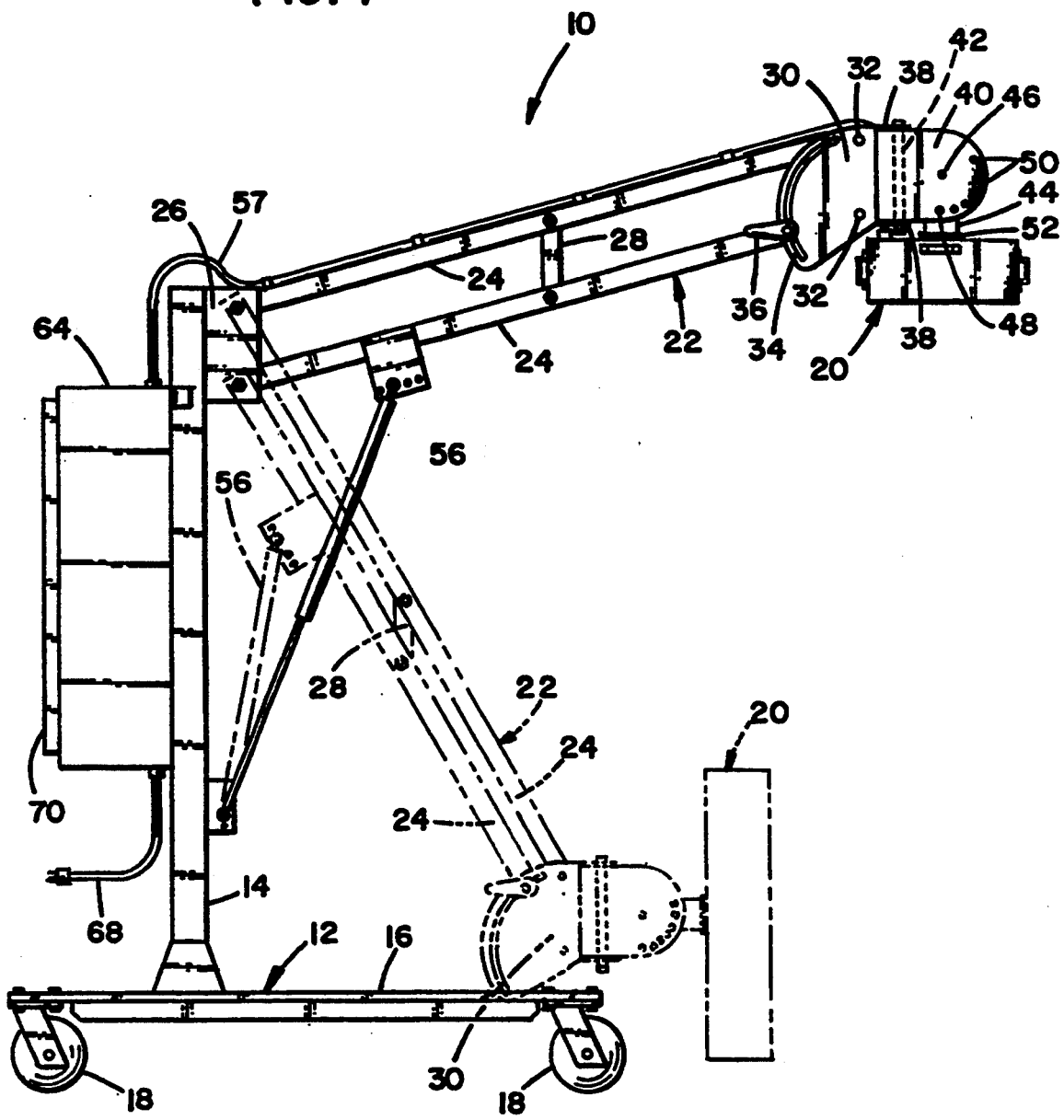
FIG. 1 is a side elevation view of an apparatus according to the present invention with alternate positioning of elements of the apparatus shown in phantom lines.

Referring now to the several drawing Figs. in which identical elements are numbered identically throughout, a preferred embodiment of the present invention will now be described. Indicated at numeral 10, an apparatus is generally shown for heat treating an article body. Preferably, the apparatus 10 is for use with curing or otherwise heat treating an automobile finish.

The apparatus 10 includes a stand 12 having a vertical support post 14 carried on a support platform 16. The support platform 16 has attached to its underside wheels or coasters 18 which permit the stand 12 to be positioned adjacent an automobile.

The stand 12 carries an infrared heater 20. The heater 20 is attached to the support post 14 by an adjustably positionable support arm 22.

Shown in FIG. 1, support arm 22 comprises two parallel support rods 24. First ends of the support rods 24 are pivotably secured to a mounting bracket 26 carried on an upper end of vertical support post 14. The distal ends of the support rods 24 are pivotably connected to a position adjustment plate 30 to which the infrared heater is attached, as will be described. A linkage 28 connects the rods 24 at an intermediate location.

The plate 30 is pivotable connected to each of the support rods 24 by pivot pins 32. An arcuate slot 34 is formed in plate 30. Adjustment knob 36 is carried on a shaft which passes through slot 34 and is received in either of support rods 24. By tightening the adjustment knob 36, the relative positioning of support rods 24 can be fixed resulting in fixed positioning of the support arm 22 relative to the vertical support post 14. In FIG. 1, an alternative positioning is shown in phantom lines. It will be appreciated that a support arm 22 connected to a support post 14 as shown, forms no part of this invention per se and is described for ease of understanding of the present invention.

Plate 30 includes two vertically spaced apart tabs 38. An infrared heater mounting head 40 is provided with a vertical shaft 42 received between tabs 38 to head 40 to pivot about a vertical axis.

A head mounting bracket 44 is pivotable secured to mounting head 40 by a pivot pin 46. A retaining pin 48 extending through head mounting bracket 44 and into anyone of a plurality of holes 50 formed through mounting head 40. The retaining pin 48 permits the head mounting bracket 44 to be fixed in any one of a plurality of positions pivoted about the axis of pivot pin 46.

The infrared heater 20 is attached to the head mounting bracket 44 by a rotatable coupling 52. The coupling 52 permits heater 20 to be rotated about the longitudinal axis of the head mounting bracket 44.

As a result of the structure described, the apparatus 10 may be accurately positioned adjacent a surface to be heat treated. The adjustable arm 22 permits the heater 20 to be raised or lowered. The mounting head 40 permits the heater 20 to be pivoted relative to the stand 12. Further, the adjustable head mounting bracket 44 and rotatable coupling 52 permit the heater 20 to be pivoted and swiveled with respect to the mounting head 40. The combination of structure permits great flexibility in positioning of the infrared heater 20 relative to an automobile body.

It will be appreciated that the combination of elements thus described form no part of this invention per se and are described for the purposes of facilitating an understanding of the present invention. Such a combination is shown in U.S. Pat. No. 5,050,232.

Figure 3:
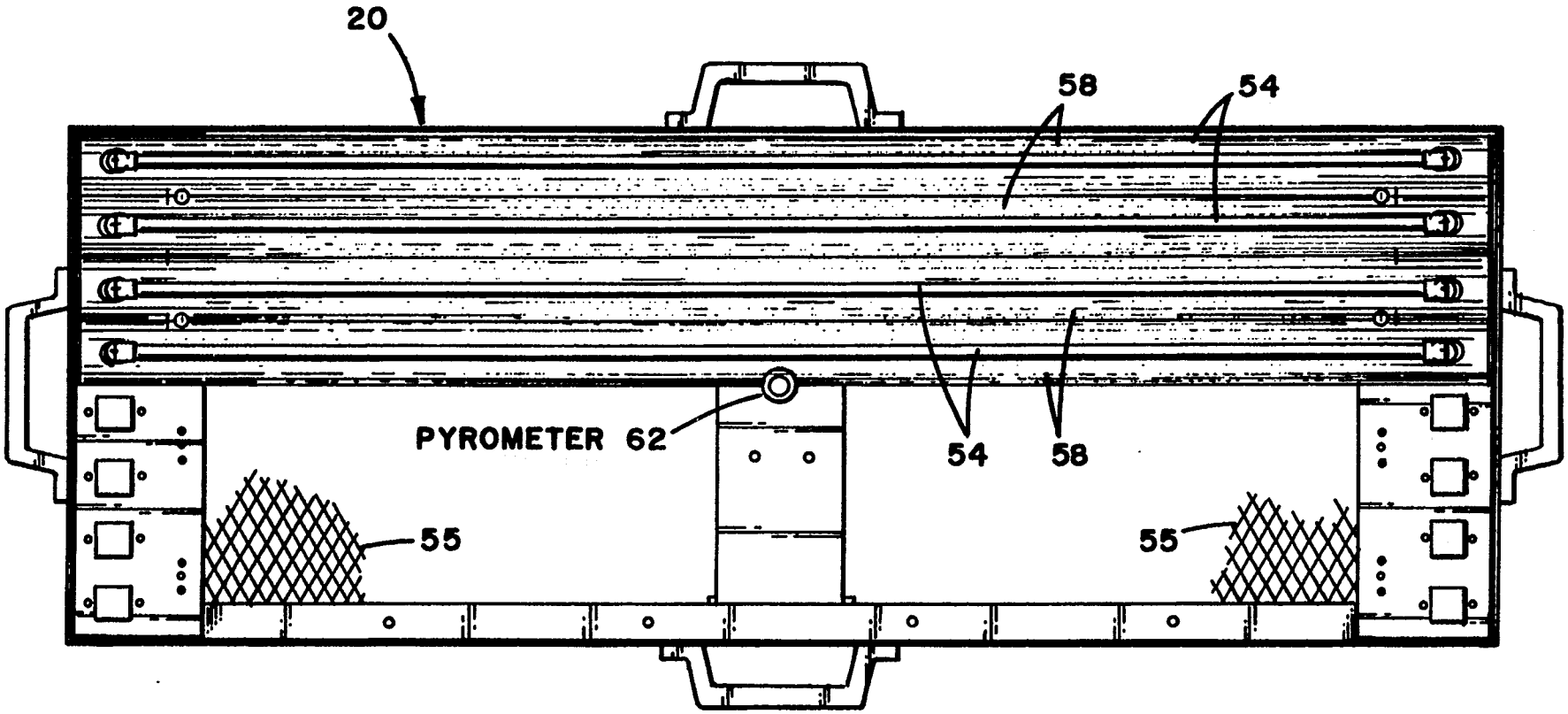
FIG. 3 is a front plan view, shown partially in section, of a infrared heater for use with the present invention.
Figure 4:
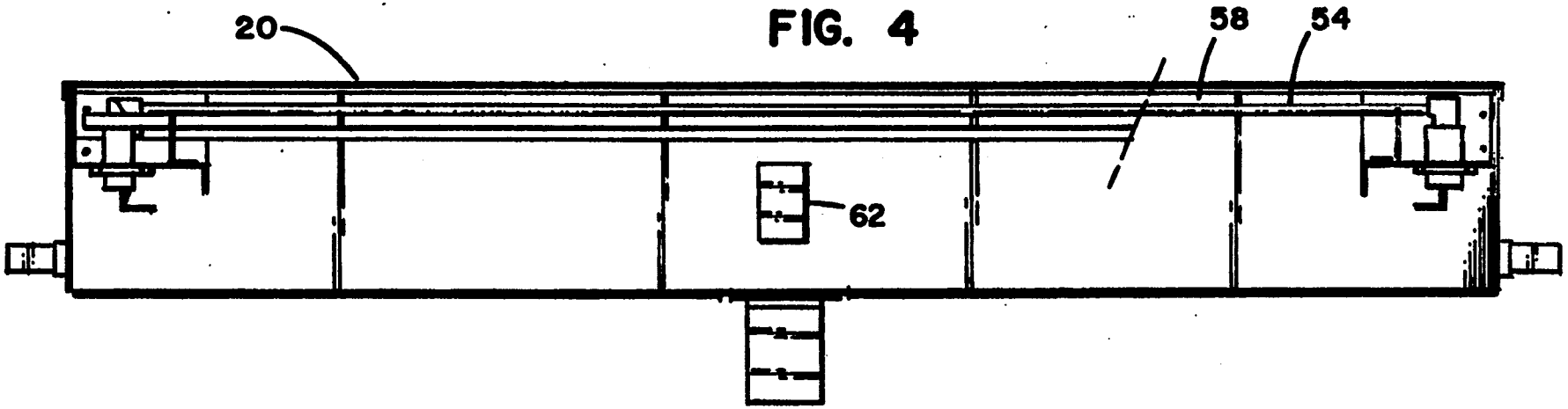
FIG. 4 is a side view of the heater of FIG. 4.
Figure 5:
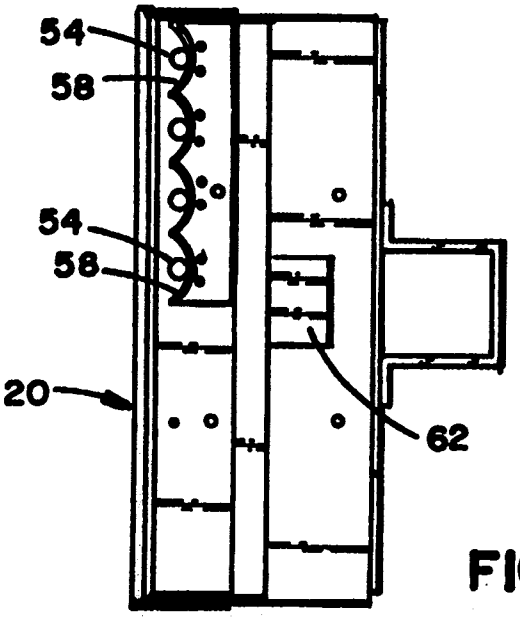
FIG. 5 is an end view of the heater of FIG. 4.

Shown best in FIGS. 3 through 5, infrared heater 20 carries a plurality of infrared lamps 54. To counterbalance the weight of the infrared heater 20, gas-filled piston assembly 56 is provided pivotably connected between vertical post 14 and support arm 22 (see FIG. 1).

The infrared heater 20 is generally box-like in configuration. The heater 20 contains a reflecting panel 58 in the form of parabolic reflecting troughs for reflecting radiation from lamps 54 toward the surface of an automobile body to be treated. For purposes that will become apparent, an optical pyrometer 62 is mounted in the heater 20 to be directed toward the surface being heat treated by the lamps 54. The optical pyrometer 62 senses the temperature of a surface which is being heat treated and transmits a signal indicative of the sensed temperature. It will be appreciated that optical pyrometers such as pyrometer 62 are commercially available.

Figure 2:
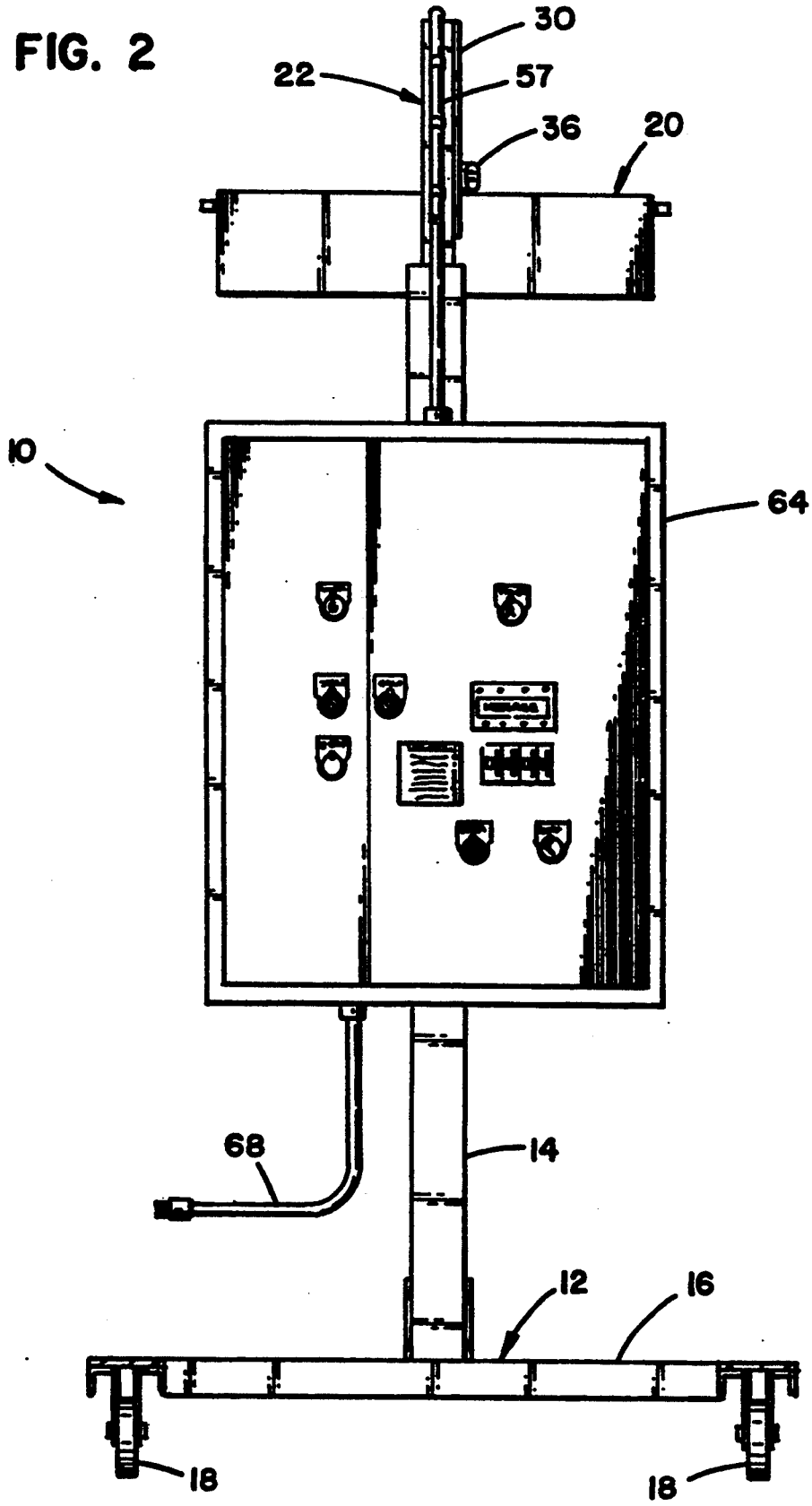
FIG. 2 is a rear elevation view of the apparatus of the present invention.

A control box 64 is carried on stand 12 (see FIGS. 1 and 2). Control box 64 contains circuitry for controlling the intensity of the infrared lamps 54. A cable 57 connects the circuitry of the control box 64 to the infrared lamps 54 and the optical pyrometer 62. Means, such as a conventional electrical plug 68, connects the circuitry of the control box 64 to a power source (not shown).

The circuitry of the control box 64 includes means for inputting at least one parameter (but preferably a plurality of parameters) by which an operator can more accurately and thoroughly control the heating of an automobile body through use of the infrared lamps 54. Further, the control circuitry contained within box 64 includes a feed back loop by sensing, through optical pyrometer 62, the temperature of the surface being heat treated.

Figure 6:
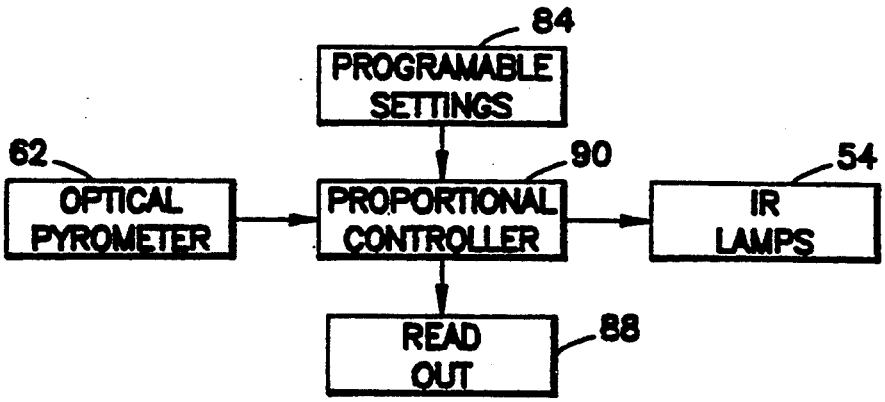
FIG. 6 is a block diagram showing a circuit for controlling the apparatus of the present invention.

The control box contains control circuitry for providing a closed-loop proportional controlled system for controlling the intensity of the infrared lamps 54 in response to a measured temperature as measured via optical pyrometer 62. A more complete description of the circuitry of the apparatus 10 is shown and described in U.S. Pat. No. 5,050,232, incorporated herein by reference. The control mechanism is schematically shown in FIG. 6 which includes programmable settings 84 which may provide inputs, etc. which can be set by an operator. The circuitry also includes a proportional controller 90 which receives the inputs from the programmable settings 84 as well as the input from the optical pyrometer 62. The proportional controller provides operator readable readouts 88 as well as controlling the intensity of the lamps 54. Since the proportional controller 90 utilizes the input from the optical pyrometer 62, correct aiming of the optical pyrometer 62 is important since the closed-loop control can only control to the level of accuracy of the feed back information given to it by the optical pyrometer 62.

Figure 7:
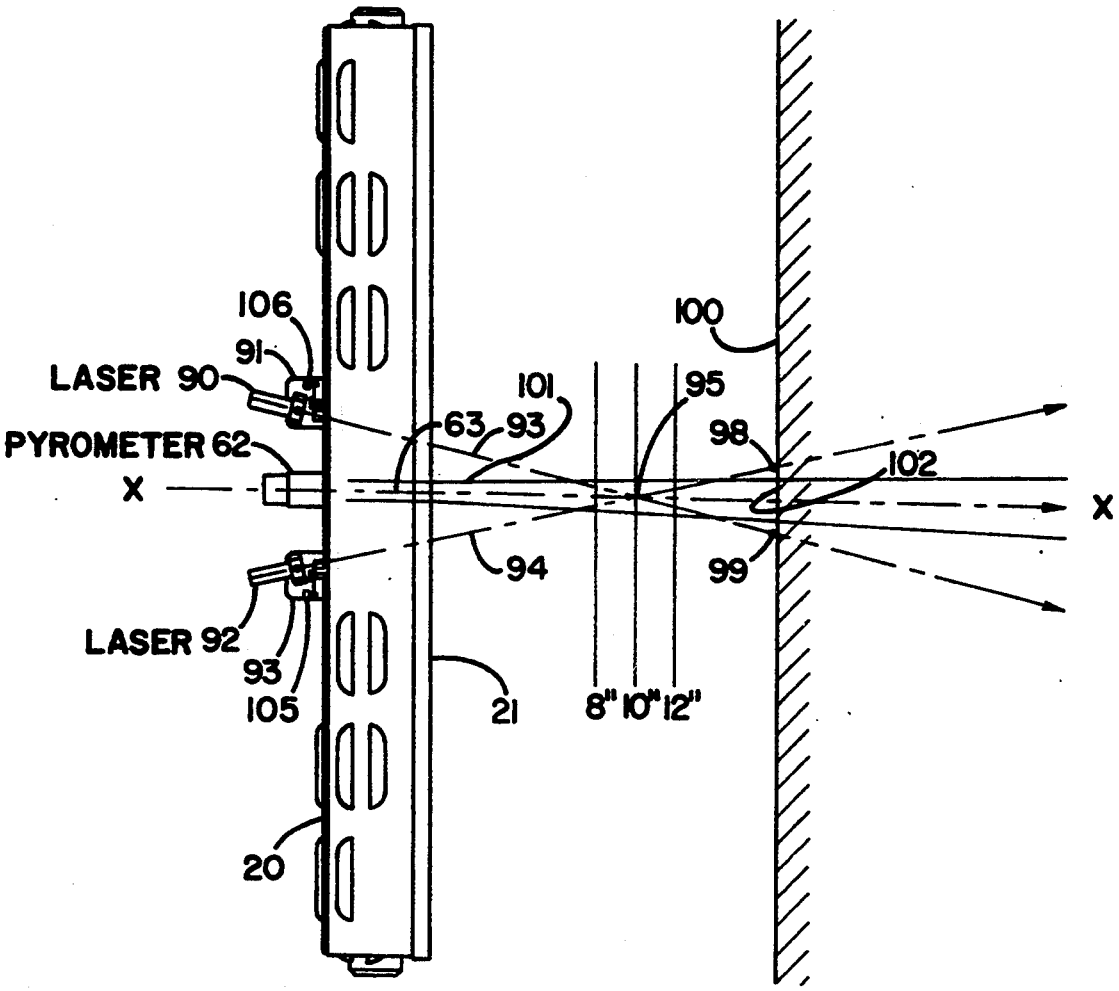
FIG. 7 is a top plan view of the heater with dual laser sighting.

The present invention provides means for enhanced sighting and aiming of the optical pyrometer 62. For ease of illustration, the sighting means is not shown in FIGS. 1–6. Instead, the sighting mechanism of the invention is best shown in FIG. 7. In FIG. 7, the heater 20 is shown with its front surface 21 aimed toward a target surface 100. The optical pyrometer 62 is shown centrally mounted on heater 20. The optical pyrometer 62 senses heat from an area 102 on surface 100. The area 102 is that area of surface 100 intersected by the sensing cone 101.

First and second lasers 90,92 are carried on heater 20 and mounted thereto by adjustable mounting brackets 91,93. The lasers 90,92 are mounted to project laser beams 93,94 at an angle relative to an axis X-X of the pyrometer 62. Accordingly, the laser beams 93,94 intersect at an intersection point 95 spaced from surface 21. Further, the lasers 90,92 are mounted such that the intersection point 95 intersects the axis line X—X of pyrometer axis 63. The lasers 90,92 have their angular positions on heater 20 preset such that the intersection point 95 is accurately controlled. For example, in a preferred embodiment, the axis point 95 may be spaced about 10" from surface 21.

When positioning the heater 20 against a surface 100, unless the surface 100 is located exactly 10" from surface 21, the operator will notice two visible light dots 98,99 at the point where the laser beams 93,94 hit surface 100. The operator can then move the heater 20 towards or away from surface 100 such that the light dots 98,99 converge toward one another into a single dot indicating that the intersection 95 is positioned on the surface 100. At this point, the operator knows that the surface 100 is exactly 10" from the surface 21. Further, the operator knows the precise aiming of the optical pyrometer 62 since the intersection point 95 is centrally positioned within the pyrometer sensing area 102. The angular positioning of lasers 90,92 may be modified by adjustable screws 105,106 or the like such that the lasers 90,92 may be set in any one of a plurality of desired angular positions such that the intersection point 95 may be varied in distance from the surface 21. For example, an operator may desire to preset the angular positions of lasers 90,92 such that the intersection point 95 is 8", 10" or 12" from surface 21.

Figure 8:
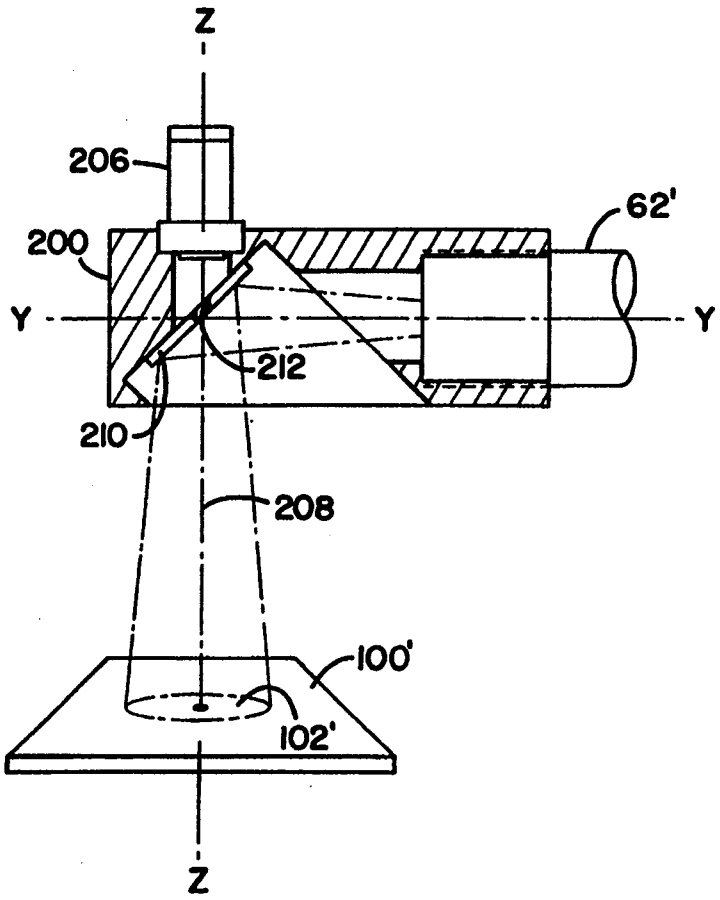
FIG. 8 is a cross-sectional view of a mechanism providing single laser sighting.
Figure 9:
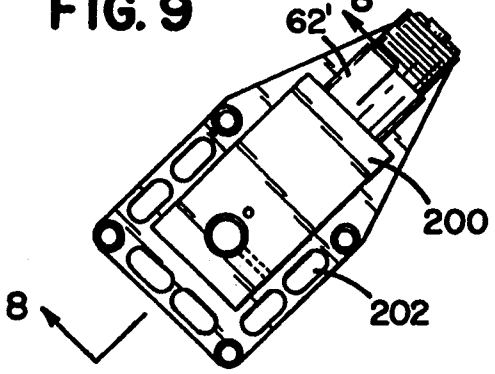
FIG. 9 is a top plan view of the apparatus of FIG. 8.
Figure 10:
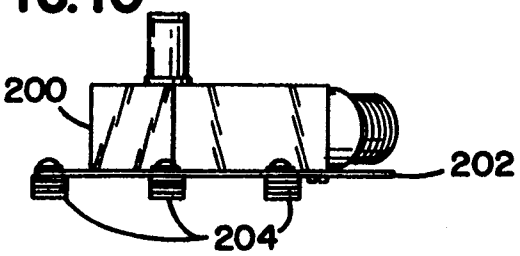
FIG. 10 is a side elevation view of the apparatus of FIG. 8.

FIGS. 8–10 show an alternative embodiment for providing a sensing mechanism for the apparatus 10. In FIG. 8, the optical pyrometer 62' is connected to a housing 200 which may be mounted on heater 20 through use of a mounting plate 202 which is held in spaced relation from the heater 20 by standoffs 204.

With best reference to FIG. 8, the optical pyrometer 62' is mounted with its axis Y—Y generally perpendicular to an axis Z—Z of a laser 206 generating a laser beam 208. A mirror 210 is mounted within the housing 200 at a 45° angle to the axis Y—Y. As a result, when mounted on a heater 20, the heat from a surface 100' is detected by the optical pyrometer 62' since the energy from the surface is reflected from the pyrometer sensing area 102' to the pyrometer 62' via the mirror 210.

The mirror is provided with a hole 212 therethrough (shown exaggerated in size in FIG. 8). The hole permits the laser beam 208 to project unimpeded from laser 206 to the sensing area 102'. The laser 206 is positioned such that the laser beam 208 projects centrally through the axis of the pyrometer sensing area 102'. Accordingly, with use of this assembly, an operator can utilize the laser beam to accurately position the pyrometer on the surface to be detected. With the embodiment of FIGS. 8–10, the laser 206 can be provided as an optional feature in the product.

In both the embodiments of FIGS. 7 and the embodiments of FIGS. 8–10, any suitable circuitry (not shown) may be provided to energize the laser at the selection of an operator such that the laser may be turned on when sighting and positioning the heater 20 and be turned off after the heater 20 is in place in its desired position.

Having described the present invention with reference to a preferred embodiment, it has been shown how the objects of the invention have been attained. However, the foregoing description of a preferred embodiment is not intended to limit the scope of the present invention and is intended to include all modifications and equilavents thereof.

What is claimed is:

1. An apparatus for heat treating a finish applied to a surface of a body, said apparatus comprising:

a movable platform;

at least one infrared lamp secured to said platform for movement therewith and having an adjustable position relative to said platform;

power connect means for connecting said lamp to a source of electrical power;

heat detection means for detecting a temperature of said surface, said heat detection means having a directional axis, said heat detection means connected to said lamp for movement therewith;

circuit means for controlling the energization of said lamp and including said heat detection means; and sighting means for aiming said lamp at said surface with said sighting means including means for indicating to an operator a location on said surface against which said heat detection means is aimed, said sighting means connected to said lamp for movement therewith, said sighting means including a distance indicating means for indicating when said heat detection means is spaced from said surface by a predetermined distance, said sighting means further including at least a first and second light source disposed at an angle to said directional axis of said heat detection means; said first and second light sources disposed for first and second beams generated by said first and second light sources, respectively, to intersect at a point disposed within a target area of said heat detection means and at said predetermined distance.

2. An apparatus according to claim 1 wherein said sighting means includes a distance indicating means for indicating when said heat detection means is spaced from said surface by a predetermined distance.

3. An apparatus according to claim 1 wherein said heat detection means includes means for detecting a temperature of a target area of said surface, said sighting means including a light source for projecting a beam of visible light toward said target area.

4. An apparatus according to claim 3 wherein said light source is positioned for said beam to be centrally located on said target area.

5. An apparatus according to claim 2 wherein said heat detection means includes means for detecting a temperature of a target area of said surface, said sight means including a light source for projecting a beam of visible light through said target area.

6. An apparatus according to claim 2 wherein said sighting means includes at least a first and second light source disposed at an angle to an axis of a direction of said heat detection means; said first and second light sources disposed for first and second beams generated by said first and second light sources, respectively, to intersect at a point disposed within a target area of said heat detection means and at said predetermined distance.

7. An apparatus for heat treating a finish applied to a surface of a body, said apparatus comprising:

at least one infrared lamp secured to said platform for movement therewith and having an adjustable position relative to said platform;

power connect means for connecting said lamp to a source of electrical power;

heat detection means for detecting a temperature of said surface, said heat detection means connected to said lamp for movement therewith;

circuit means for controlling the energization of said lamp and including said heat detection means;

sighting means for aiming said lamp at said surface with said sighting means including means for indicating to an operator a location on said surface against which said heat detection means is aimed, said sighting means connected to said lamp for movement therewith;

said heat detecting means including means for detecting a temperature of a target area of said surface, said sighting means including a light source for projecting a beam of visible light toward said target area;

said sighting means including a mirror opposing said surface, said mirror and heat detection means mutually positioned for said heat detection means to be aimed to measure heat from said surface as reflected off of said mirror, said mirror including an opening therethrough, said light source positioned for said beam to pass through said mirror toward said surface within a target area of said heat detection means.

8. An apparatus for heating treating a finish applied to a surface of a body, said apparatus comprising:

a movable platform;

at least one infrared lamp secured to said platform for movement therewith;

power connect means for connecting said lamp to a source of electrical power;

heat detection means for detecting a temperature of said surface including means for detecting a temperature of a target area of said surface, said heat detection means secured to said lamp in fixed relative position for movement therewith;

circuit means for controlling energization of said lamp and including said heat detection means;

sighting means for aiming said lamp at said surface with said sighting means including means for indicating to an operator a location on said surface against which said heat detection means is aimed, said sighting means including a light source for projecting a beam of visible light toward said target area, said sighting means secured to said lamp for movement therewith;

said sighting means including means to direct both said heat detection means and said light source along an axis of direction of said heat detection means.

* * * * *